US005887474A

United States Patent [19]

Cutshall et al.

[11] Patent Number: 5,887,474

[45] Date of Patent: Mar. 30, 1999

[54] METHOD FOR MANUFACTURING A ROCKER ARM

[75] Inventors: Mark L. Cutshall, Livonia; Wallace E. Smith, Novi, both of Mich.

[73] Assignee: E & E Manufacturing Company, Inc., Plymouth, Mich.

[21] Appl. No.: 40,838

[22] Filed: Mar. 18, 1998

Related U.S. Application Data

[60] Provisional application No. 60/041,426 Mar. 20, 1997.

[51] Int. Cl.[6] ..... B21D 53/84

[52] U.S. Cl. ..... 72/315; 72/379.2; 29/888.2; 123/90.39

[58] Field of Search ..... 72/311–315, 335, 72/355.4, 391.2, 379.2; 29/888.2, 890.148, 890.149, 890.11, 888.03; 123/90.39

[56] References Cited

U.S. PATENT DOCUMENTS

| | | | |
|---|---|---|---|
| 1,892,712 | 1/1933 | Taylor | 29/890.148 |
| 2,368,394 | 1/1945 | Zummach | 72/313 |
| 2,811,959 | 11/1957 | Etchells . | |
| 2,905,160 | 9/1959 | Sampietro | 72/379.2 |
| 2,905,161 | 9/1959 | Latham . | |
| 2,910,897 | 11/1959 | Huet | 72/392 |
| 2,917,033 | 12/1959 | Brogren | 72/379.2 |
| 3,082,755 | 3/1963 | Gropp . | |
| 3,150,648 | 9/1964 | Gropp . | |
| 3,194,200 | 7/1965 | Brogren | 72/379.2 |
| 3,198,183 | 8/1965 | Ball . | |
| 3,270,727 | 9/1966 | Nance . | |
| 3,289,657 | 12/1966 | Winter, Jr. . | |
| 3,621,823 | 11/1971 | Lombardi . | |
| 3,667,434 | 6/1972 | Sandusky . | |
| 3,973,548 | 8/1976 | Celli | 123/90.1 |
| 4,614,171 | 9/1986 | Malhotra . | |
| 4,624,223 | 11/1986 | Wherry et al. . | |
| 4,697,473 | 10/1987 | Patel . | |
| 4,784,095 | 11/1988 | Golding et al. . | |
| 4,872,429 | 10/1989 | Anderson et al. . | |
| 4,944,257 | 7/1990 | Mills | 123/90.34 |
| 5,010,857 | 4/1991 | Hemplemann et al. | 123/90.39 |
| 5,063,889 | 11/1991 | Pryba et al. | 123/90.39 |

FOREIGN PATENT DOCUMENTS 57-184530 11/1982 Japan .

OTHER PUBLICATIONS

International Search Report from corresponding PCT application.

*Primary Examiner*—Daniel C. Crane
*Attorney, Agent, or Firm*—Brooks & Kushman P.C.

[57] ABSTRACT

The present invention provides a method and apparatus for forming an outwardly extending tubular portion in a side wall of a workpiece, such as a rocker arm. The method includes the following steps: (1) positioning the workpiece in a punch press having a central shaft with a movable punch mounted in an aperture formed in the central shaft for lateral sliding movement with respect to the shaft; (b) extending the central shaft into the interior cavity of the workpiece; and (c) actuating lateral sliding movement of the movable punch against the side wall of the workpiece to cold form the outwardly extending tubular portion in the side wall.

18 Claims, 8 Drawing Sheets

METHOD FOR MANUFACTURING A ROCKER ARM

CROSS REFERENCE TO RELATED APPLICATION

This application is related to Provisional Application Ser. No. 60/041,426, filed Mar. 20, 1997, which is hereby incorporated by reference.

TECHNICAL FIELD

The present invention relates to a method for manufacturing a rocker arm, and more specifically to a method and apparatus for forming an outwardly extending tubular portion in a workpiece.

BACKGROUND OF THE INVENTION

Rocker arms for vehicle engines are typically challenging to manufacture because they require a structurally sound tubular portion extending laterally through the part.

The prior art provides many methods of manufacturing rocker arms. One method is to stamp the part and drill a main aperture through the part. A tube is then inserted into the aperture to form the structurally sound tubular portion extending through the rocker arm and to provide structural integrity to the assembly. The assembly is then subject to brazing and honing operations. This method is not particularly efficient because the inserted tube results in added cost and manufacturing time.

Another example of a prior art rocker arm manufacturing process includes casting the entire rocker arm with the central tube formed integrally therewith. This method requires expensive secondary machining operations. It also requires cross ribs for added strength.

Accordingly, it is desirable to provide an improved method of manufacturing a workpiece, such as a rocker arm, with a structurally sound tubular portion extending through the part. It is also desirable to provide an improved rocker arm design in which manufacturing costs are reduced, and structural integrity is not compromised.

DISCLOSURE OF THE INVENTION

The present invention provides a method of manufacturing a rocker arm in which the entire part is stamped and cold formed as a single unit in order to improve structural integrity and decrease manufacturing costs.

One aspect of the present invention provides a method of cold-forming or extruding tube structures on opposing sides of the rocker arm bodies, wherein the tube structures are cold formed outwardly from the center of the part. No prior art manufacturing method provides such a method or apparatus for cold forming a tube structure from the interior of the part.

More specifically, the present invention provides a method of forming an outwardly protruding portion in a sidewall of a workpiece having an interior cavity. The method includes: (a) positioning the workpiece in a punch press having a carrier with a movable punch slidably mounted to the carrier for lateral sliding movement with respect to the carrier; (b) positioning the carrier at least partially within the interior cavity of the workpiece; and (c) actuating lateral sliding movement of the movable punch against the side wall of the workpiece to form the outwardly protruding portion in the side wall. The step of positioning the carrier at least partially within the interior cavity of the workpiece may be accomplished by a movable or non-movable carrier.

Another aspect of the invention provides a method of forming an outwardly-extending tubular portion in a side wall of a workpiece having an interior cavity. The method includes: (a) positioning the workpiece in a punch press having a central shaft with a movable punch mounted in an aperture formed in the central shaft for lateral sliding movement with respect to the shaft; (b) extending the central shaft into the interior cavity of the workpiece; and (c) actuating lateral sliding movement of the movable punch against the sidewall of the workpiece to cold form the outwardly extending tubular portion in the side wall.

A further aspect of the invention provides a punch press having an upper shoe and a lower shoe. A floating punch retainer includes a central shaft movable in a first direction between the upper and lower shoes. The central shaft includes an aperture formed there-through along an axis perpendicular to the first direction. A movable punch is positioned within the aperture and slidable along the axis for cold forming a workpiece. A heeled cam is driven by the upper shoe for actuating sliding movement of the movable punch.

The method and apparatus described are useful in forming a structurally sound tubular portion in a rocker arm for use in a vehicle engine, or for manufacturing any workpiece having an outwardly extending portion in a side wall thereof.

Accordingly, an object of the present invention is to provide an improved method and apparatus for manufacturing a rocker arm, as well as an improved rocker arm design which provides reduced manufacturing costs and improved structural integrity.

A further object of the invention is to provide a method of forming an outwardly extending portion in a side wall of any workpiece having an interior cavity.

The above objects and other objects, features and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
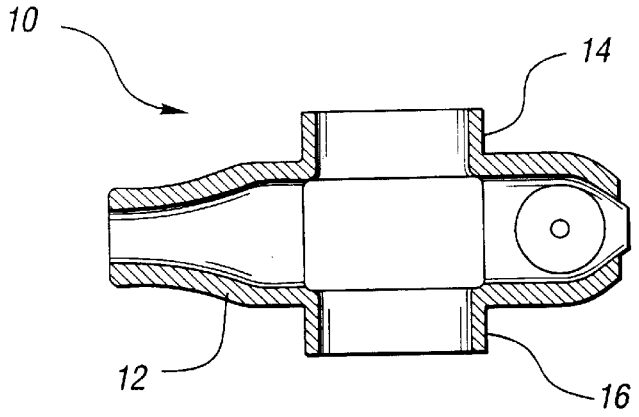
FIG. 1 shows a longitudinal vertical cross-sectional view of a rocker arm in accordance with the present invention.
Figure 2:
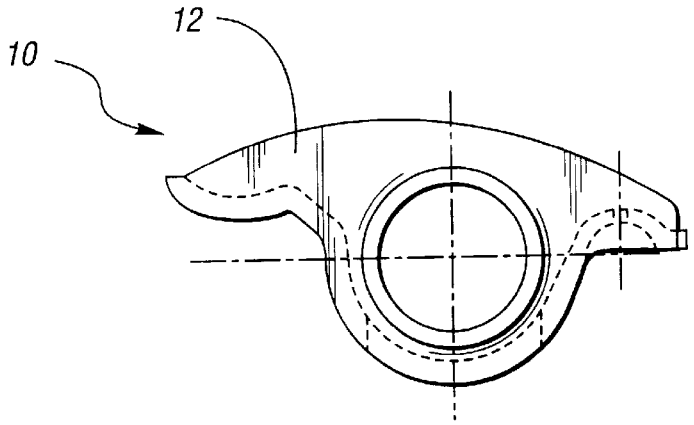
FIG. 2 shows a side view of the rocker arm of FIG. 1.
Figure 3:
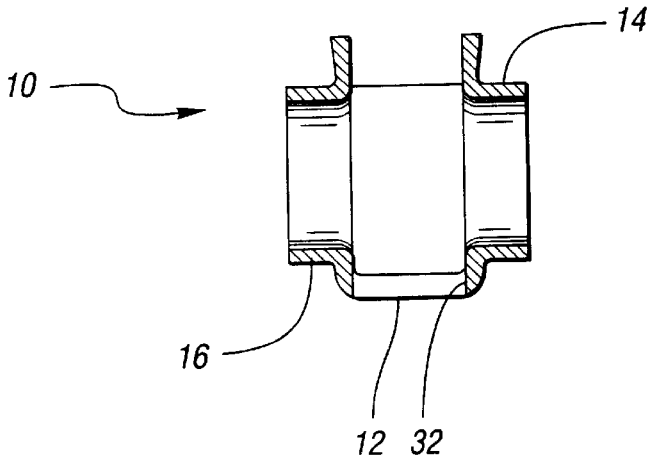
FIG. 3 shows a lateral vertical cross-sectional view of the rocker arm of FIG. 1.

Referring to the drawings, FIGS. 1–3 illustrate a rocker arm 10 cold formed in accordance with the present invention. As shown, the rocker arm 10 includes a main body 12 with tube structures 14,16 formed on opposing sides of body structure 12. By cold forming the tube structures 14,16 integrally with the body 12, structural integrity of the component is greatly enhanced, and manufacturing costs are reduced.

Figure 4:
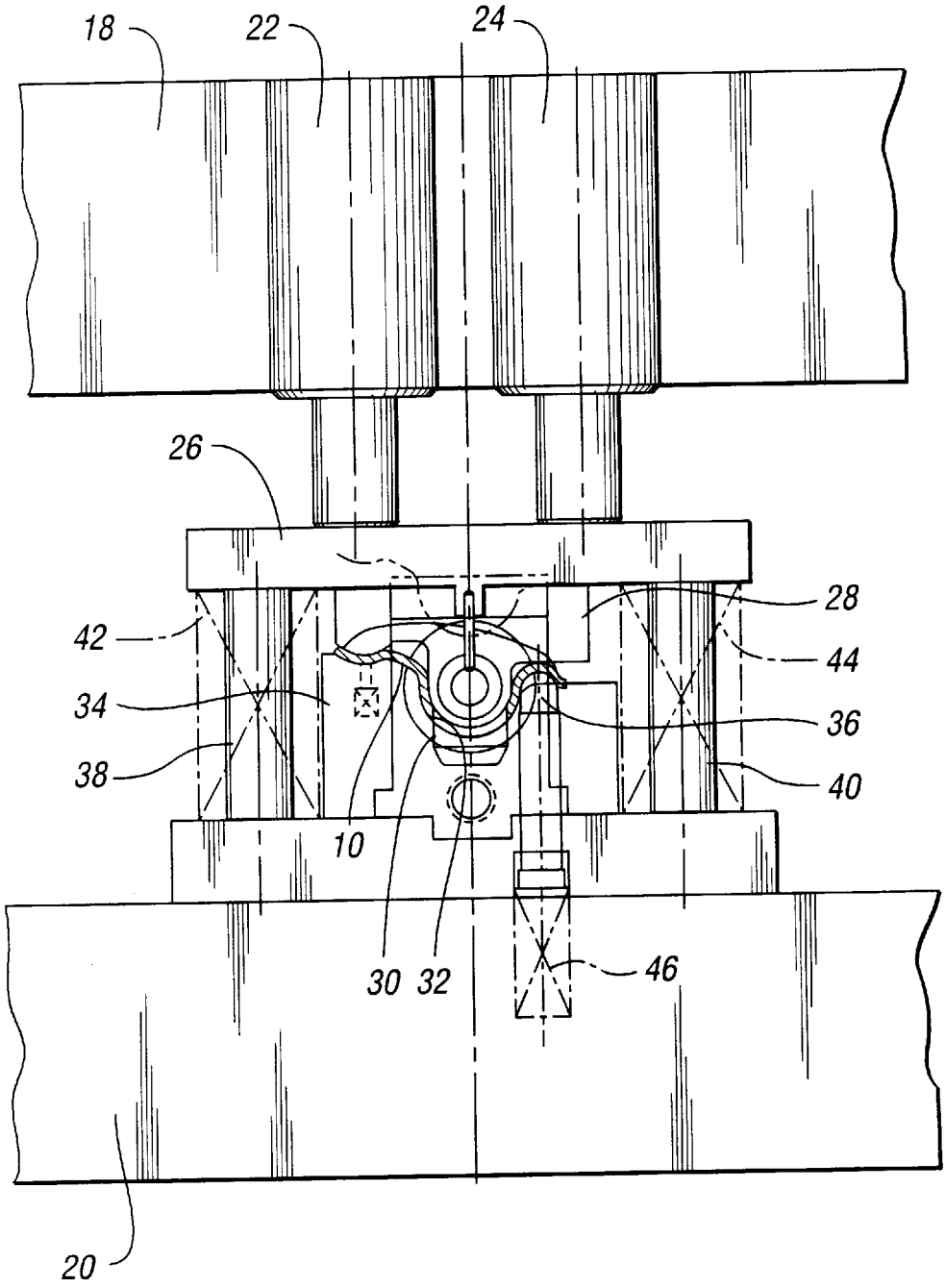
FIG. 4 shows a schematically arranged partially cut-away side view of a punch press in accordance with the present invention.

The method of the present invention is described with reference to FIGS. 4–6. Referring to FIG. 4, the apparatus includes upper and lower shoes 18,20. The upper shoe 18 has nitrous oxide cylinders 22,24 positioned therein for actuating the lower punch spring plate 26. The lower punch spring plate 26 drives the floating punch retainer 28 such that the central shaft (or carrier) 30 of the floating punch retainer 28 engages the aperture 32 of the rocker arm 10 to properly locate the rocker arm 10 on the part nest 34. The ejector pin 36 also helps to nest and locate the rocker arm 10. The assembly also includes guide posts 38,40 with springs 42,44 disposed thereon, respectively, for biasing the assembly to an open position. The ejector pin 36 also includes a spring 46.

Figure 5:
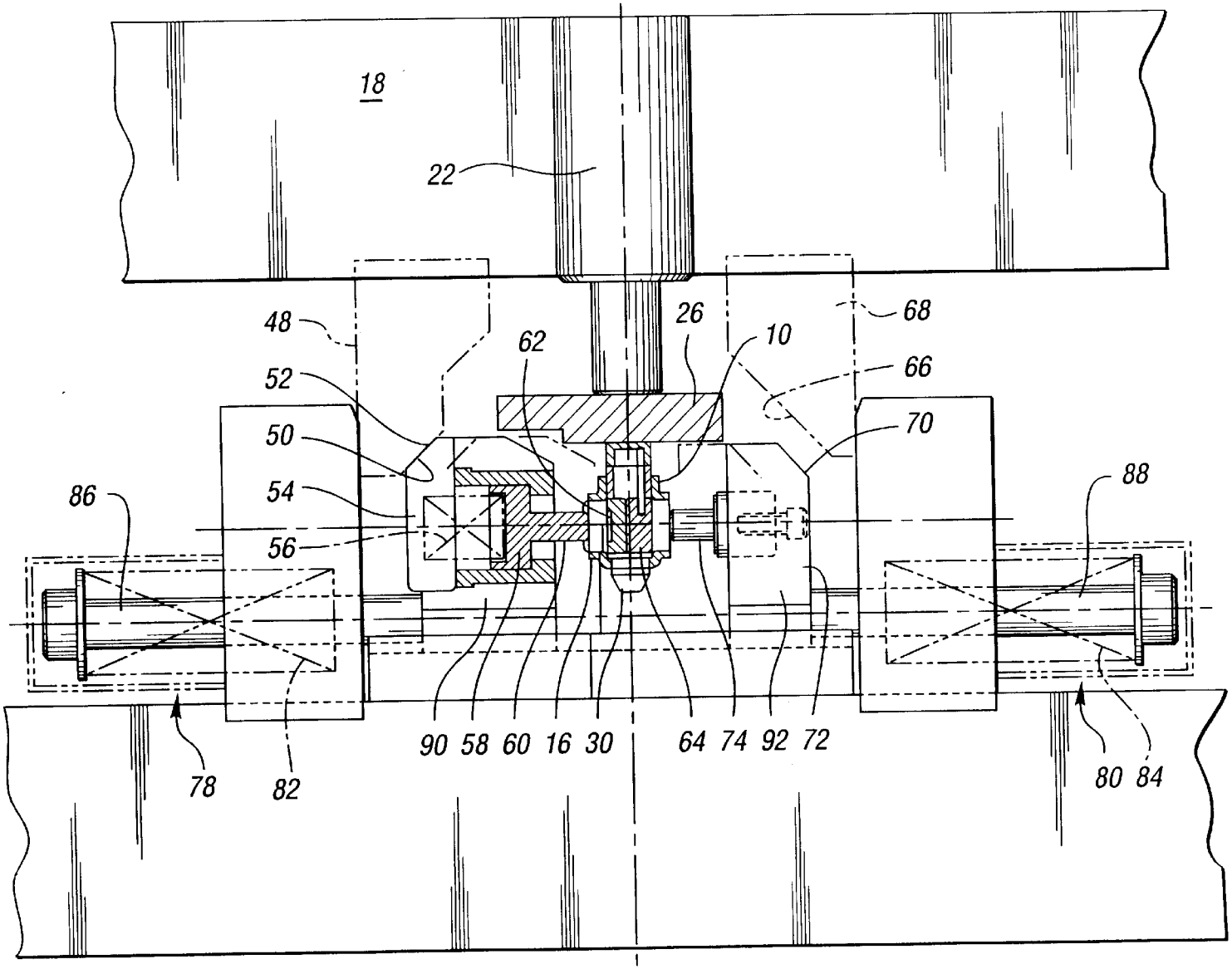
FIG. 5 shows an enlarged partially cut-away side view of the punch press of FIG. 4 with the heeled cam engaging the locator cam.
Figure 6:
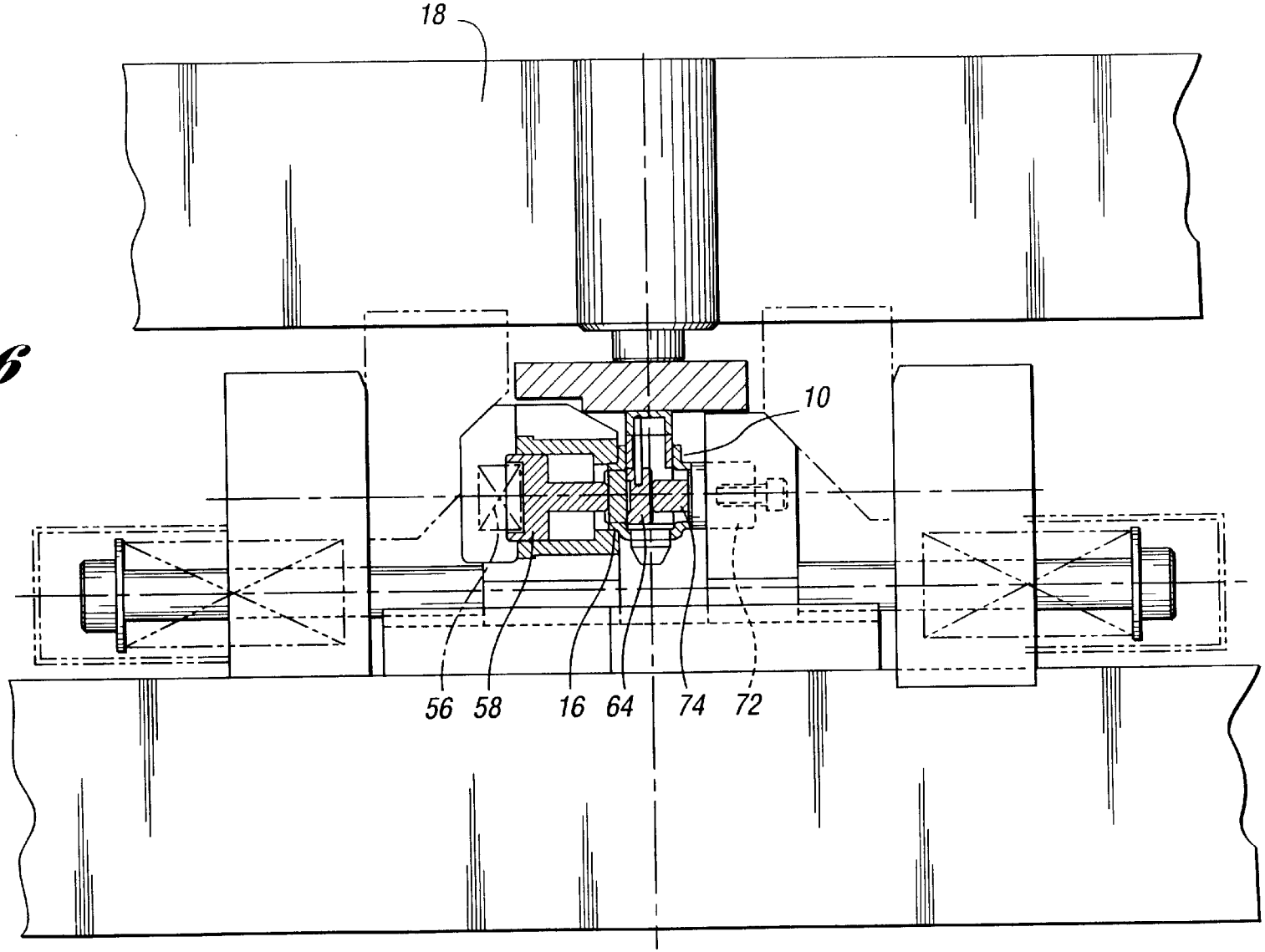
FIG. 6 shows the side view of FIG. 5 after the rocker arm has been cold formed.

Turning to FIGS. 5 and 6, the sequence of operations is described. The first step, as described with reference to FIG. 4, is that the nitrous oxide cylinder 22 actuates the lower punch spring plate 26 to drive the central shaft (or carrier) 30 of the floating punch retainer 28 downward for engaging and nesting the part 10. As the upper shoe 18 moves downward, the heeled cam 48 advances downward after the lower punch spring plate 26 bottoms out. As the heeled cam 48 moves downward, its cam surface 50 engages the cam surface 52 of the driver 54. The spring 56 pushes the floating locator 58 forward until the locator bar 60 engages the slot 62 formed in the punch 64. The punch 64 is a generally cylindrical-shaped member which is slidable within an aperture formed through the central shaft (or carrier) 30 of the floating punch retainer 28.

After the heeled cam 48 has advanced the floating locator 58 forward to a position in which it engages the punch 64 for properly locating the punch 64, the cam surface 66 of the heeled cam 68 then engages the cam surface 70 of the punch driver 72 for advancing the punch bar 74 forward until it engages the punch 64, and moves the punch 64 in a manner to cold form the tubular structure 16 on the rocker arm 10. As the punch 64 is advanced forward, thus cold forming the tubular structure 16 in the rocker arm, the floating locator 58 compresses the spring 56 and clears away to allow such cold forming to occur.

In the position shown in FIG. 6, the punch driver 72 has driven the punch bar 74 forward to advance the punch 64 so that the tubular structure 16 is cold formed into the rocker arm 10, and the floating locator 58 has been pushed backward to compress the spring 56. This position represents the fully closed position. In this manner, the tubular structure has been formed onto one side of the part from the center of the part. Once this has occurred, the upper shoe 18 is retracted, and the retract drivers 78,80 cause the locator driver 54 and punch driver 72 to retract to allow removal of the part. The retract drivers comprise springs 82,84 disposed on rods 86,88, respectively. The rods 86,88 are secured to blocks 90,92 which respectively support the locator driver 54 and punch driver 72.

Figure 7:
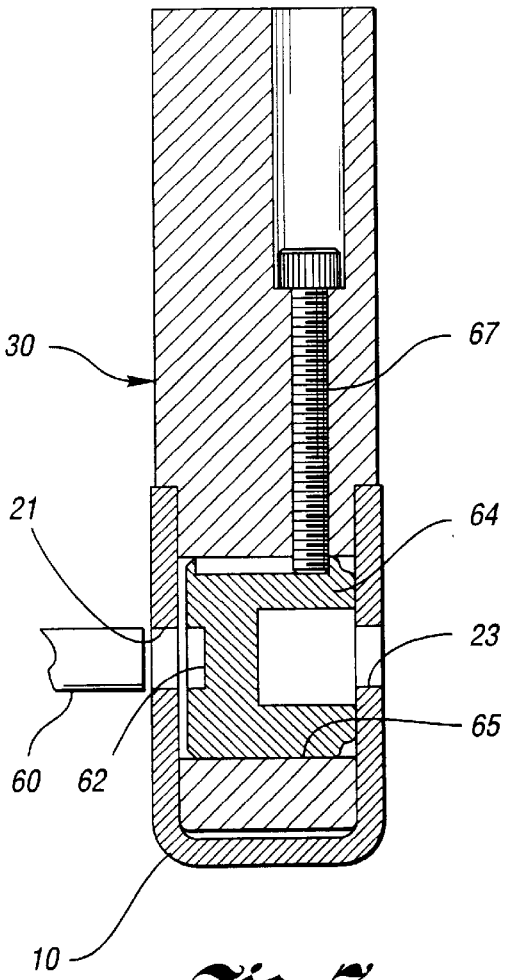
FIG. 7 shows a cut-away vertical cross-sectional view of a punch carrier and locator bar in accordance with the embodiment of FIG. 4.
Figure 8:
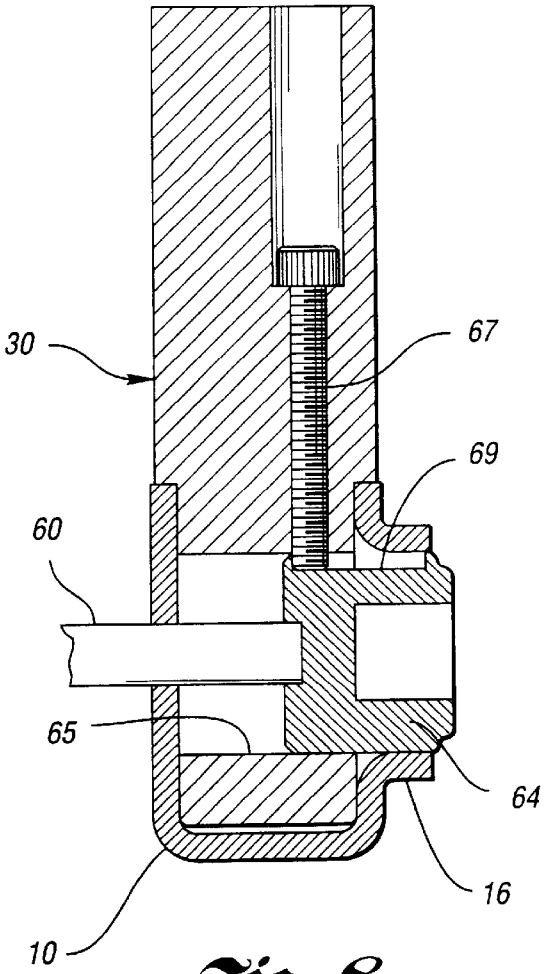
FIG. 8 shows a cut-away vertical cross-sectional view of the punch carrier and locator bar of FIG. 7 after cold forming.

The central shaft (or carrier) 30 is more clearly shown in FIGS. 7 and 8. As shown, the movable punch 64 is slideably retained than the aperture 65 formed through carrier 30. The locator bar 60 passes through the second hole 21 formed in the rocker arm 10 for engagement within the punch slot 62 to properly locate the punch 64 prior to cold-forming. Turning to FIG. 8, the locator bar 60 is advanced forward to move the punch 64 through the first hole 23 (shown in FIG. 7) to form the outwardly extending tubular portion 16 in the side wall of the rocker arm 10. As shown, the punch 64 includes a retainer screw slot 69 which receives the retainer screw 67 for limiting movement of the punch 64 within the aperture 65. Accordingly, the punch 64 is allowed only limited travel with respect to the carrier 30.

Figure 9:
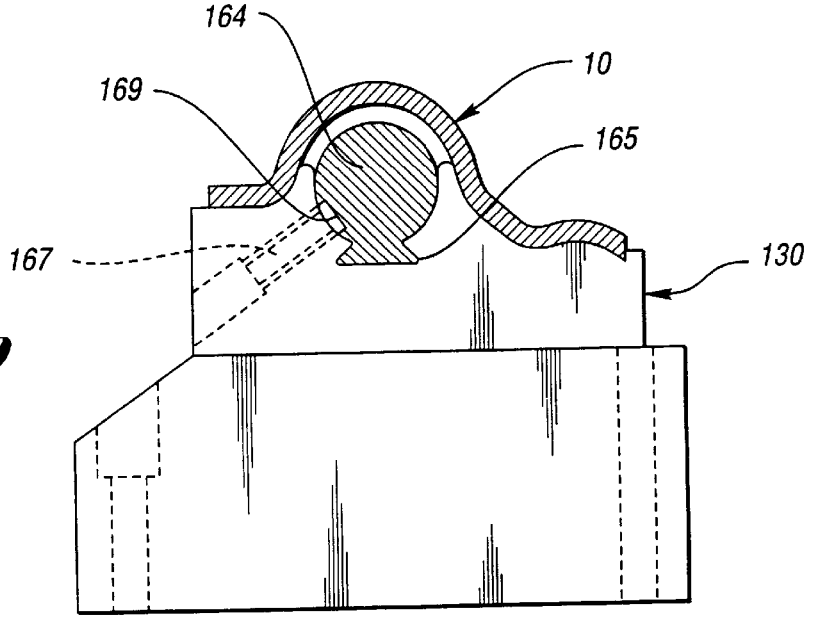
FIG. 9 shows a schematically arranged vertical cross-sectional view of a stationary punch carrier in accordance with an alternative embodiment of the invention.
Figure 10:
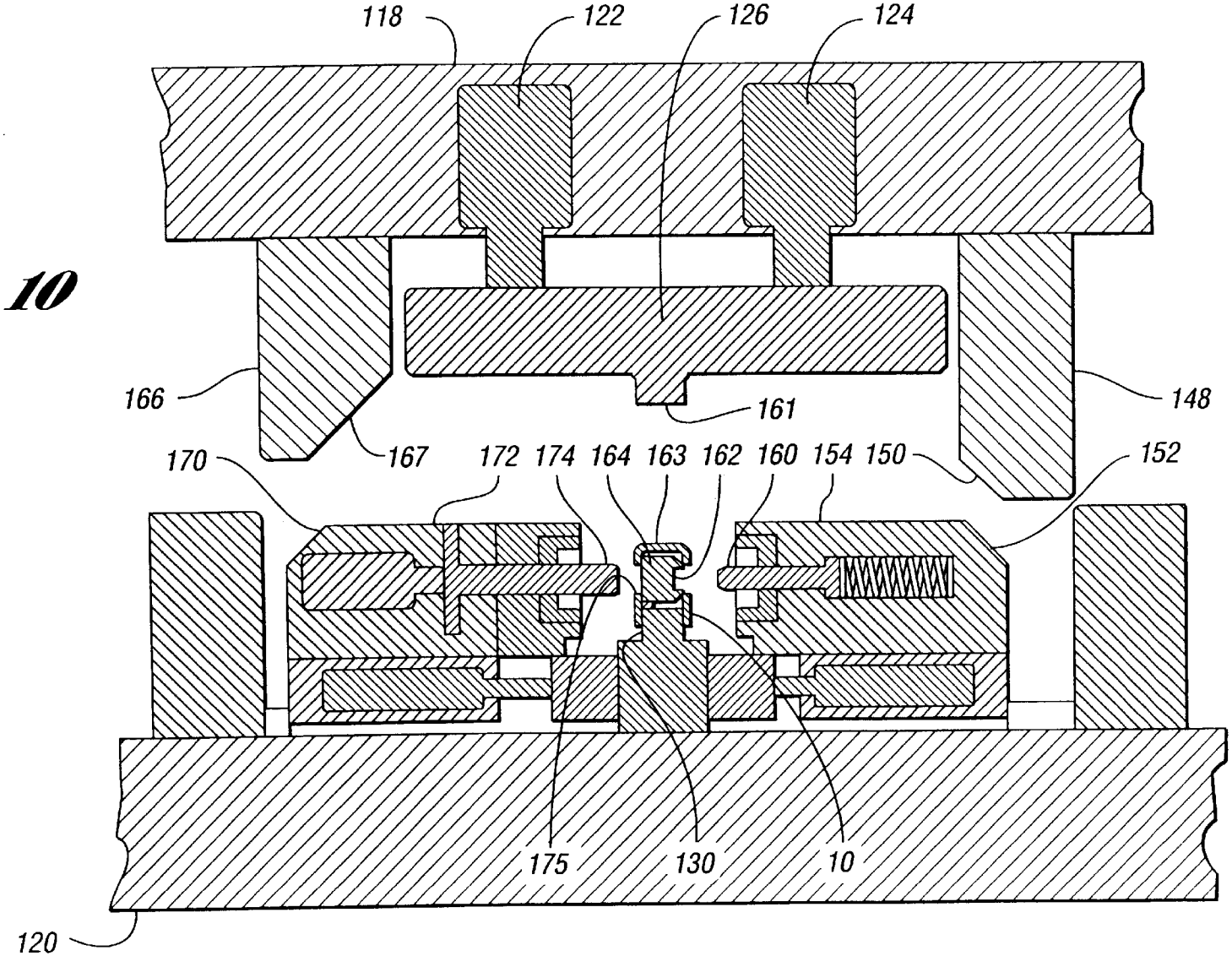
FIG. 10 shows a partially cut-away vertical cross-sectional view of a punch press in accordance with the embodiment of FIG. 9.
Figure 11:
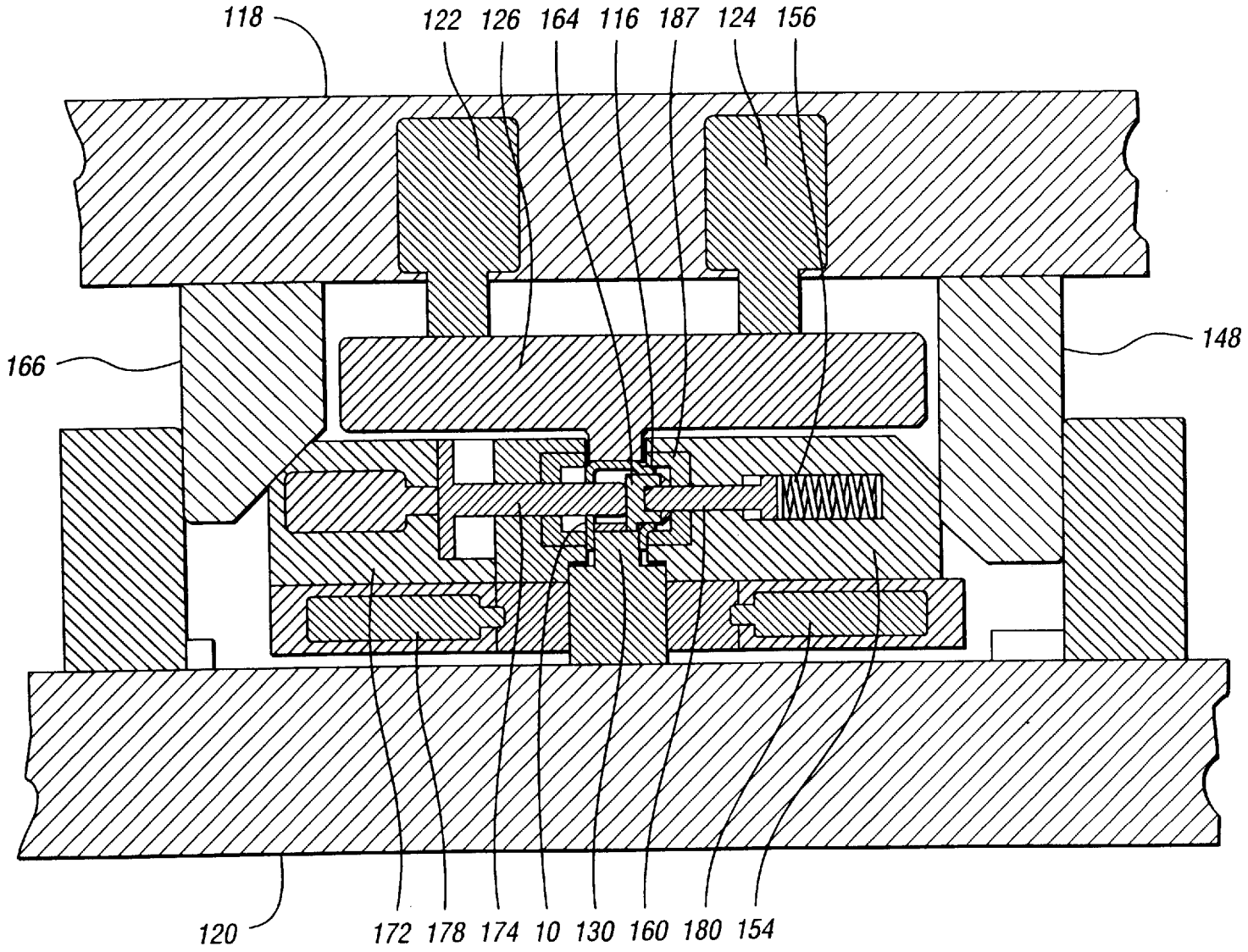
FIG. 11 shows a partially cut-away vertical cross-sectional view of the punch press of FIG. 10 after cold forming.

Turning to FIGS. 9–11, an alternative embodiment is shown. This embodiment is described, for example, for use with a progressive die, wherein the rocker arm 10 would be shuttled into position on the stationary carrier 130 (as opposed to the moveable carrier 30 described above with respect to the first embodiment) for cold forming. As shown in FIG. 9, a dove tail slot 165 is formed in the stationary carrier 130 to receive the sliding punch 164 to facilitate cold forming of the rocker arm 10. A retainer screw 167 is provided for cooperation with a retainer screw slot 169 formed in the sliding punch 164 for limiting the range of sliding movement of the sliding punch 164 (similar to function of components 67 and 69 described with respect to the first embodiment above).

As shown in FIGS. 10 and 11, the stationary carrier 130, described with reference to FIG. 9, is positioned between upper and lower shoes 118,120 of a progressive die. Nitrous oxide cylinders 122,124 are provided for driving a lower punch spring plate 126. As the upper shoe 118 moves downward toward the lower shoe 120, the cam surface 150 of the healed cam 148 engages the cam surface 152 to actuate lateral movement of the driver 154 to cause engagement of the locator bar 160 within the locating slot 162 of the movable punch 164. As the locator bar 160 engages within the slot 162, the abutting part 161 of the lower punch spring plate 126 engages the top surface 163 of the rocker arm 10 to maintain the position of the rocker arm 10 during cold forming.

The upper shoe 118 continues to move downward and the cam surface 168 of the healed cam 166 engages the cam surface 170 of the punch driver 172 to advance the punch driver bar 174 through the hole 175 in the rocker arm 10 to drive the sliding punch 164 laterally to cold form the outwardly protruding portion 116 in the rocker arm 10 as shown in FIG. 11. As the punch bar 174 is moved forward for cold forming, the movement of the punch 164 causes retraction of the locator bar 160 which compresses the spring 156. The retract drivers 178,180 are used to retract the drivers 154 and 172 for removal of the rocker arm 10. The bushing 187 is used to guide the formation of the tubular portion 116 as the punch 164 is moved laterally. The bushing 187 must, accordingly, be retracted to allow extraction of the part.

Figure 12:
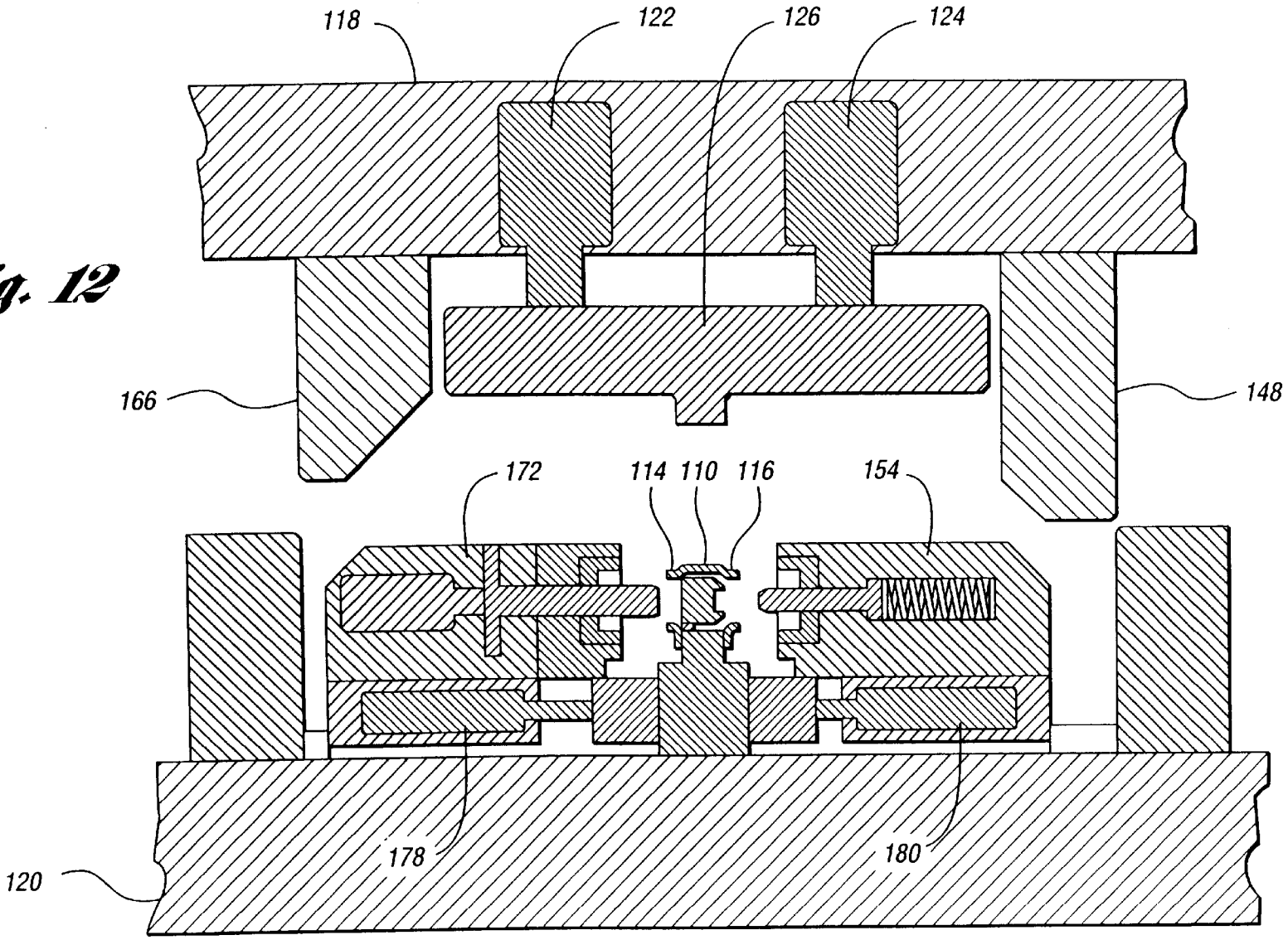
FIG. 12 shows a partially cut-away cross-sectional view of the punch press of FIGS. 10 and 11 in the open position with a preformed rocker arm positioned therein.

FIG. 12 shows the die assembly of FIGS. 10 and 11 in the open position after a rocker arm 110 has been cold formed.

As shown, the rocker arm 110 includes opposing tubular structures 114 and 116 on opposing sides of the rocker arm. This may be accomplished by forming one tubular structure 114 in the part 110 in a first die, and then transferring the part 110 to a second die to form the opposing tube structure 116. In the position shown in FIG. 12, the retract drivers 178,180 have retracted the drivers 172,154 for part removal.

The outwardly protruding tubular structures 14, 16, 114, 116 formed by the sliding punch 64,164 of the present invention may comprise any outwardly protruding portion formed in a side wall of a workpiece having an interior cavity. For example, the outwardly protruding portion may be tubular, square, irregular, a plurality of outwardly protruding tabs, etc. Also, the material of the workpiece may be steel, aluminum, plastic, etc. Additionally, the term "form" or "forming" used herein is intended to include cold forming, extruding, stamping, etc.

An alternative embodiment of the present invention would comprise the above-described disclosure, except that the punch 64,164 would be punched in both directions to cold form the opposing tube structures 14,16 on the rocker arm 10 in a single press operation. In this embodiment, the locator assembly would be eliminated, and punch drivers would be positioned on both sides of the part to be cold formed.

While the best mode for carrying out the invention has been described in detail, those familiar with the art to which this invention relates will recognize various alternative designs and embodiments for practicing the invention within the spirit and scope of the invention claimed.

What is claimed is:

1. A method of forming an outwardly-protruding portion in a side wall of a workpiece having an interior cavity, the method comprising:

positioning the workpiece in a punch press having a carrier with a movable punch slidably mounted to the carrier for lateral sliding movement with respect to the carrier;

positioning the carrier at least partially within the interior cavity of the workpiece;

actuating lateral sliding movement of said movable punch against the side wall of the workpiece to form the outwardly-protruding portion in the side wall; and engaging a locator bar with the movable punch to properly locate the punch prior to said actuating step.

2. The method of claim 1, wherein said step of positioning the workpiece comprises positioning the workpiece on a non-movable carrier, such that said steps of positioning the workpiece and positioning the carrier comprise a single step.

3. The method of claim 1, wherein said actuating step for forming the outwardly-protruding portion comprises forming an outwardly-extending tubular portion.

4. The method of claim 1, further comprising positioning a movable bushing against the workpiece prior to said actuating step, said bushing having a bushing opening therein to guide said forming of the outwardly-protruding portion.

5. The method of claim 1, wherein said actuating step comprises providing a movable cam member adjacent the movable punch, and driving a heeled cam toward said movable cam member to actuate movement of the movable cam member and punch for cold forming.

6. The method of claim 1, further comprising spring-biasing said locator bar toward the movable punch so that the locator bar is free to move away from the central shaft against the spring-bias as said cold forming occurs.

7. The method of claim 5, further comprising retracting the movable bushing after said actuating step for removal of the workpiece.

8. A method of forming an outwardly-extending tubular portion in a rocker arm having a central aperture therein, the method comprising:

positioning the rocker arm in a punch press having a central shaft with a movable punch mounted in the central shaft for lateral sliding movement with respect to the central shaft;

extending the central shaft into the central aperture to properly locate the rocker arm within the punch press; and actuating lateral sliding movement of said movable punch against a side wall of the rocker arm to cold form the outwardly-extending tubular portion in the side wall of the rocker arm.

9. The method of claim 8, wherein said step of positioning a rocker arm in a punch press comprises positioning a rocker arm having first and second opposing side walls with first and second holes formed therein, respectively, and said step of extending the central shaft comprises extending the central shaft between the first and second opposing side walls.

10. The method of claim 9, further comprising engaging a locator bar with the movable punch to properly locate the punch prior to said actuating step.

11. The method of claim 9, further comprising positioning a movable bushing against the rocker arm prior to said actuating step, said bushing having a bushing opening therein to guide said cold forming of the tubular portion.

12. The method of claim 9, wherein said actuating step comprises providing a movable cam member adjacent the movable punch, and driving a heeled cam toward said movable cam member to actuate movement of the movable cam member and punch for cold forming.

13. The method of claim 10, further comprising spring-biasing said locator bar toward the movable punch so that the locator bar is free to move away from the central shaft against the spring-bias as said cold forming occurs.

14. The method of claim 12, wherein said driving step comprises driving the movable cam member through said second hole to engage the movable punch.

15. A punch press, comprising:

an upper shoe movable in a first direction toward a lower shoe;

a carrier positioned between the upper and lower shoes;

a movable punch slidably mounted to the carrier for lateral movement with respect to the carrier in a direction perpendicular to said 1st direction for cold-forming a workpiece; and a heeled cam driven by said upper shoe for actuating sliding movement of the movable punch;

wherein said carrier is non-movably mounted on the lower shoe.

16. The punch press of claim 15, further comprising a spring-biased locator movable for engagement with the movable punch to properly locate the punch for cold forming.

17. The punch press of claim 16, further comprising a bushing which is movable for positioning against the workpiece, said bushing having a bushing opening therein to guide said cold forming.

18. The punch press of claim 15, wherein said carrier comprises a movable central shaft.

* * * * *